US006675712B2

(12) United States Patent
Marincic et al.

(10) Patent No.: US 6,675,712 B2
(45) Date of Patent: Jan. 13, 2004

(54) APPARATUS AND METHOD FOR PICKING A SINGLE PRINTING PLATE FROM A STACK OF PRINTING PLATES

(75) Inventors: Thomas Marincic, Tyngsboro, MA (US); Aron Mirmelshteyn, Marblehead, MA (US); Joseph Lyons, Wilmington, MA (US)

(73) Assignee: Agfa Corporation, Wilmington, MA (US)

( * ) Notice: Subject to any disclaimer, the term of this patent is extended or adjusted under 35 U.S.C. 154(b) by 0 days.

(21) Appl. No.: 10/117,412

(22) Filed: Apr. 5, 2002

(65) Prior Publication Data

US 2003/0188656 A1 Oct. 9, 2003

(51) Int. Cl.[7] ..... B65H 3/54
(52) U.S. Cl. ..... 101/477; 101/483; 271/106
(58) Field of Search ..... 101/477, 409, 101/479, 480, 483, 389.1; 271/106

(56) References Cited

U.S. PATENT DOCUMENTS 4,155,546 A * 5/1979 Jacobs ..... 271/11
4,218,054 A * 8/1980 Bauer et al. ..... 271/11
4,218,055 A * 8/1980 Krobel et al. ..... 271/106
4,311,304 A * 1/1982 Hamada et al. ..... 271/13
4,815,723 A * 3/1989 Iizuka ..... 271/14
5,879,003 A * 3/1999 Kovach et al. ..... 271/121

FOREIGN PATENT DOCUMENTS

JP 3-288737 * 12/1991

* cited by examiner

*Primary Examiner*—Leslie J. Evanisko
(74) *Attorney, Agent, or Firm*—John A. Mereki; Robert A. Sabourin

(57) ABSTRACT

An apparatus and method for picking a single printing plate from a stack of printing plates. The apparatus includes a plurality of suction cups, a peeler, a drive system for displacing the suction cups and the peeler against the surface of the top printing plate on the stack, a vacuum source for supplying a vacuum to the suction cups to secure the suction cups against the surface of the top printing plate, and a system for rotatably displacing the suction cups relative to the peeler to peel a portion of the top printing plate off of the stack. The center line of rotation of the displacing system is located at a contact point between the peeler and the surface of the top printing plate. This prevents any relative motion of the top printing plate against the next, underlying printing plate on the stack during the peeling operation.

37 Claims, 17 Drawing Sheets

APPARATUS AND METHOD FOR PICKING A SINGLE PRINTING PLATE FROM A STACK OF PRINTING PLATES

FIELD OF THE INVENTION

The present invention is in the field of imaging systems. More particularly, the present invention provides an apparatus and method for picking a single printing plate from a stack of printing plates.

BACKGROUND OF THE INVENTION

In external drum imaging systems, a movable optical carriage is commonly used to displace an image recording source in a slow scan direction while a cylindrical drum, having recording media mounted on an external surface thereof, is rotated with respect to the image recording source. The drum rotation causes the recording media to advance past the image recording source along a fast scan direction that is substantially perpendicular to the slow scan direction.

The image recording source may include an optical system for generating one or more imaging beams that are scanned across the surface of the recording media. Each imaging beam may be separately modulated according to a digital information signal representing data corresponding to the image to be recorded.

The recording media to be imaged by an external drum imaging system is commonly supplied in discrete, flexible sheets, hereinafter collectively referred to as "printing plates." Each printing plate may comprise one or more layers supported by a support substrate, which for many printing plates is a plano-graphic aluminum sheet. Other layers may include one or more image recording (i.e., "imageable") layers such as a photosensitive, radiation sensitive, or thermally sensitive layer, or other chemically or physically alterable layers. Printing plates that are supported by a polyester support substrate are also known and can be used in the present invention. Printing plates are available in a wide variety of sizes, typically ranging, e.g., from 9"×12", or smaller, to 58"×80", or larger.

A cassette is often used to supply a plurality of unexposed printing plates to an external drum imaging system. The printing plates are normally supplied in stacks of ten to one hundred, depending upon plate thickness and other factors, and are stored in the cassette. Interleaf sheets, commonly referred to as "slip sheets," may be positioned between the printing plates to protect the emulsion side of the printing plates from physical damage (e.g., scratches), which could render a printing plate unusable for subsequent printing. When Interleaf sheets are not used, great care must be taken to avoid emulsion damage as each printing plate is separated from the stack, fed from the cassette into the external drum imaging system, and mounted on the external drum. Unfortunately, preventing such damage as the printing plates are unloaded and fed from a cassette to an external drum has proven to be a very difficult and expensive task in currently available external drum imaging systems, especially when larger (e.g., 45" wide) printing plates are used.

SUMMARY OF THE INVENTION

The present invention provides an apparatus and method for picking a single printing plate from a stack of printing plates in an imaging system.

Generally, the present invention provides an apparatus, comprising:

a plurality of suction cups, a peeler, and a system for rotatably displacing the suction cups relative to the peeler, wherein a center line of rotation of the displacing system is located on a surface of the peeler.

The present invention also provides an apparatus for picking a printing plate from a stack of printing plates, comprising:

a plurality of suction cups, a peeler, a drive system for displacing the suction cups and the peeler against a surface of a top printing plate on the stack, a vacuum source for supplying a vacuum to the suction cups to secure the suction cups against the surface of the top printing plate, and a system for rotatably displacing the suction cups relative to the peeler to peel a portion of the top printing plate off of the stack, wherein a center line of rotation of the displacing system is located at a contact point between the peeler and the surface of the top printing plate.

The present invention further provides a method for picking a printing plate from a stack of printing plates, comprising:

displacing a plurality of suction cups and a peeler against a surface of a top printing plate on the stack;

supplying a vacuum to the suction cups to secure the suction cups against the surface of the top printing plate; and rotatably displacing the suction cups relative to the peeler to peel a portion of the top printing plate off of the stack, wherein a center line of rotation of the displacement is located at a contact point between the peeler and the surface of the top printing plate.

The present invention also provides a method for picking a printing plate from a stack of printing plates, comprising:

displacing a plurality of suction cups and a peeler against a surface of a top printing plate on the stack;

supplying a vacuum to the suction cups to secure the suction cups against the surface of the top printing plate; and peeling a portion of the top printing plate off of the stack, and preventing relative motion of the top printing plate against an underlying printing plate on the stack, by rotatably displacing the suction cups relative to the peeler, wherein a center line of rotation of the displacement is located at a contact point between the peeler and the surface of the top printing plate.

BRIEF DESCRIPTION OF THE DRAWINGS

The features of the present invention will best be understood from a detailed description of the invention and embodiments thereof selected for the purpose of illustration and shown in the accompanying drawings in which.

DETAILED DESCRIPTION OF THE INVENTION

Figure 1:
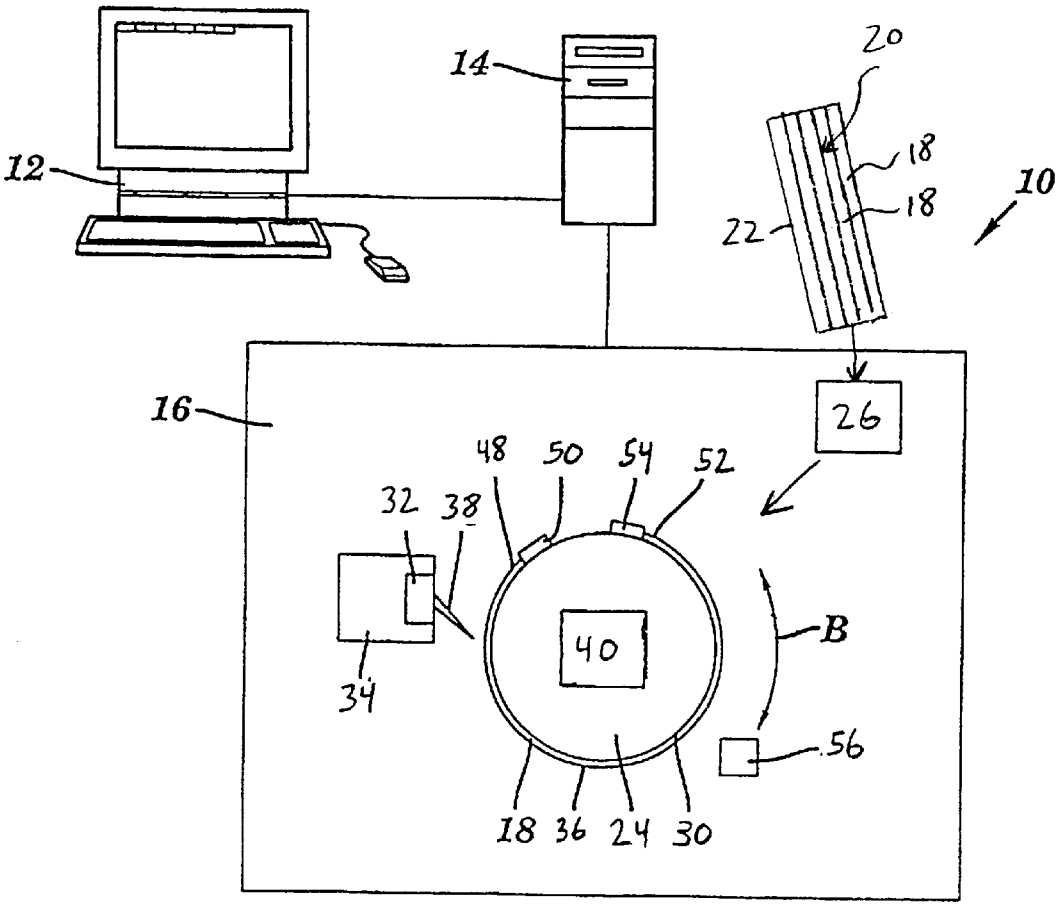
FIG. 1 illustrates an external drum imaging system for recording images onto a printing plate.

The features of the present invention are illustrated in detail in the accompanying drawings, wherein like reference numerals refer to like elements throughout the drawings. Although the drawings are intended to illustrate the present invention, the drawings are not necessarily drawn to scale.

An example of an external drum imaging system 10 is illustrated in FIG. 1. In this example, the imaging system 10 comprises an external drum platesetter configured to record digital data onto a printing plate 18. Although described below with regard to an external drum platesetter, the plate picking system of the present invention may be used in conjunction with a wide variety of other types of external drum, internal drum, or flatbed imaging systems, including imagesetters and the like, without departing from the intended scope of the present invention.

The imaging system 10 generally includes a front end computer or workstation 12 for the design, layout, editing, and/or processing of digital files representing pages to be printed, a raster image processor (RIP) 14 for processing the digital pages to provide rasterized page data (e.g., rasterized digital files) for driving an image recorder, and an image recorder or engine, such as an external drum platesetter 16, for recording the rasterized digital files onto a printing plate 18.

A stack 20 of printing plates 18 is commonly supplied in a cassette 22. A printing plate 18 is picked off of the stack 20 and subsequently mounted on an external drum 24 of the external drum platesetter 16 by an autoloading system 26. The printing plates 18 on the stack 20 are arranged one on top of the other without the use of protective slip sheets.

Figure 2:
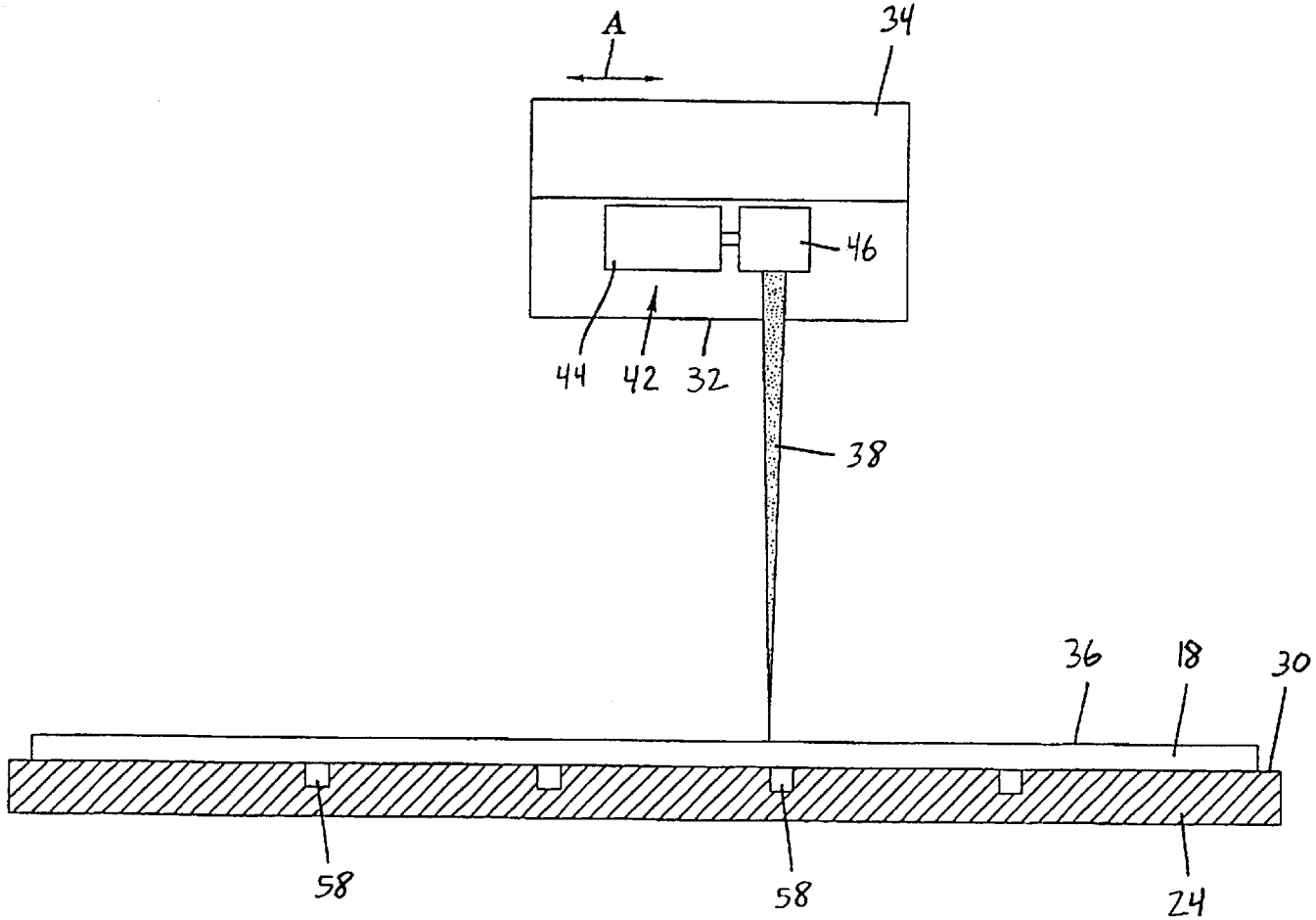
FIG. 2 illustrates an example of an imaging system including a movable optical carriage and scanning system, usable in the external drum imaging system of FIG. 1.

The external drum platesetter 16 includes an external drum 24 having a cylindrical media support surface 30 for supporting a printing plate 18 during imaging. The external drum platesetter 16 further includes a scanning system 32, coupled to a movable carriage 34, for recording digital data onto the imaging surface 36 of the printing plate 18 using a single or multiple imaging beams 38. An example of a scanning system 32 is illustrated in FIG. 2. In particular, the scanning system 32 is displaced by the movable carriage 34 in a slow scan axial direction (directional arrow A) along the length of the rotating external drum 24 to expose the printing plate 18 in a line-wise manner when a single beam is used or in a section-wise manner for multiple beams. Other types of imaging systems may also be used in the present invention.

The external drum 24 is rotated by a drive system 40 in a clockwise or counterclockwise direction as indicated by directional arrow B in FIG. 1. Typically, the drive system 40 rotates the external drum 24 at a rate of about 100–1000 rpm. As further illustrated in FIG. 2, the scanning system 32 includes a system 42 for generating the imaging beam or beams 38. The system 42 comprises a light or radiation source 44 for producing the imaging beam or beams 38 (illustrated for simplicity as a single beam), and an optical system 46 positioned between the radiation source 44 and the media support surface 30 for focusing the imaging beam or beams 38 onto the printing plate 18. It should be noted, however, that the system 42 described above is only one of many possible different types of scanning systems that may be used to record image data on the printing plate 18.

In the external drum imaging system 10 shown in FIG. 1, the leading edge 48 of the printing plate 18 is held in position against the media support surface 30 of the external drum 24 by a leading edge clamping mechanism 50. Similarly, the trailing edge 52 of the printing plate 18 is held in position against the media support surface 30 of the external drum 24 by a trailing edge clamping mechanism 54. The leading edge clamping mechanism 50 and the trailing edge clamping mechanism 54 both provide a tangential friction force between the printing plate 18 and the media support surface 30 of the external drum 24 that is sufficient to resist the tendency of the edges of the printing plate 18 to pull out of the clamping mechanisms 50, 54, at a high drum rotational speed. Other known systems for mounting the printing plate 18 onto the external drum 24 may also be used.

A vacuum source 56 may be used to draw a vacuum through an arrangement of ports and vacuum grooves 58 (FIG. 2) to hold the printing plate 18 against the media support surface 30 of the external drum 24. The vacuum source 56 may also supply a vacuum to a plate picking system that is configured to remove or "pick" the top printing plate 18 from the stack 20 of printing plates. A registration system (not shown), comprising, for example, a set of registration pins on the external drum 24, and a plate edge detection system (not shown), may be used to accurately and repeatably position and locate each printing plate 18 on the external drum 24.

Figure 3:
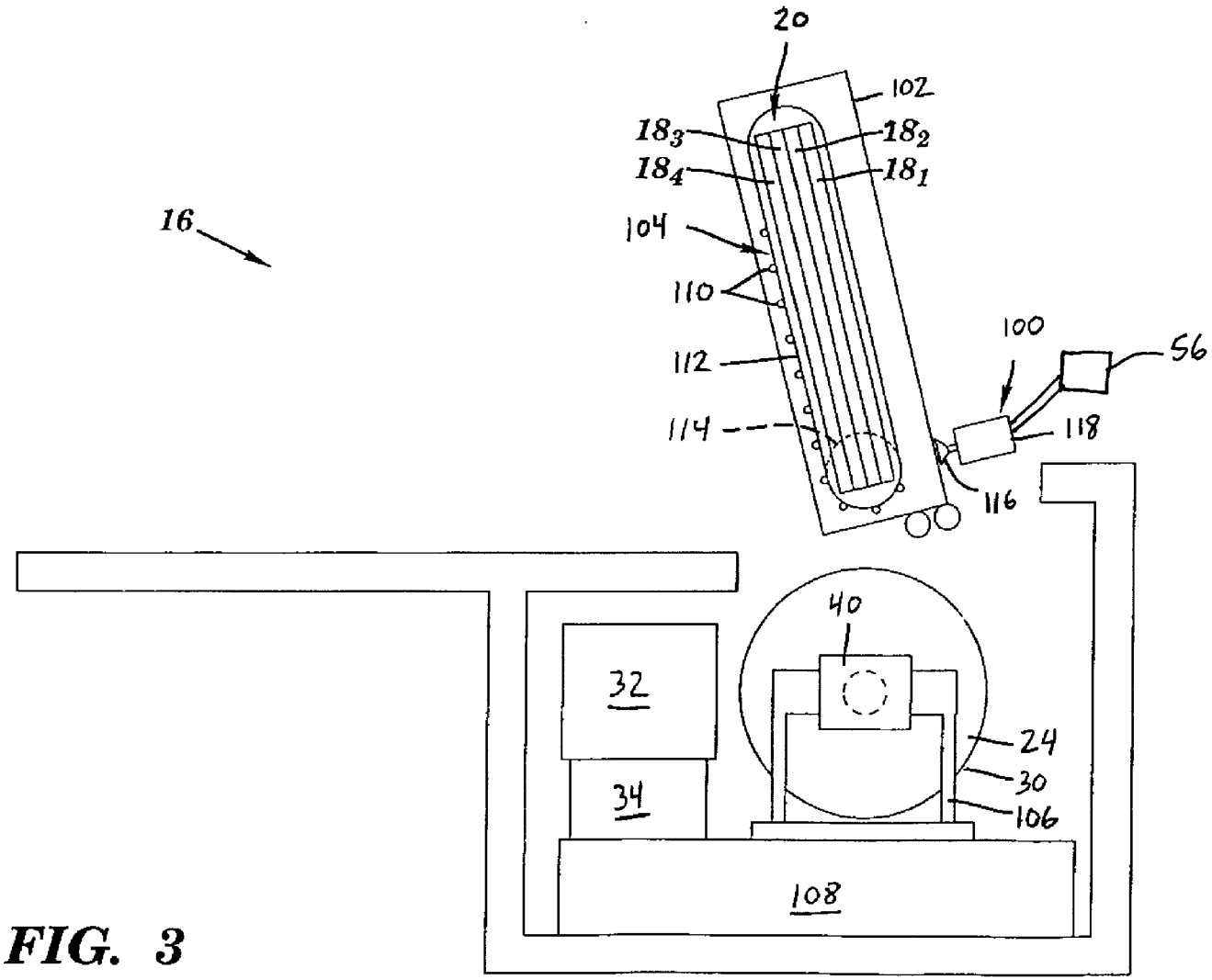
FIG. 3 is an end view of an external drum platesetter including a cassette, a printing plate picking system in accordance with the present invention, and a printing plate supporting and feeding system.

The basic structure of an external drum platesetter 16, which includes a plate picking system 100 for picking a single printing plate 18 from a stack 20 of printing plates 18 in accordance with the present invention, is illustrated in FIG. 3. In this example, the stack 20 of printing plates 18 are provided in a cassette 102 having a printing plate supporting and feeding system 104. The external drum platesetter 16 includes an external drum 24 having a cylindrical media support surface 30 for supporting a printing plate 18 during imaging. The external drum 24 is supported by a frame 106. A drive system 40 rotates the external drum 24 during imaging. A scanning system 32, carried by a movable carriage 34, travels axially along the rotating external drum 24 to record digital data onto the imaging surface of a printing plate mounted on the external drum 24. The external drum 24 and scanning system 32 are positioned on a base 108.

The cassette 102 contains a stack 20 of printing plates 18 (e.g., twenty-five printing plates). Only four printing plates 181, 182, 183, 184, are illustrated in FIG. 3 for clarity. Protective slip sheets are not present between the individual printing plates 18 of the stack 20. The printing plates 18 are manually loaded and stacked within the cassette 102, which is intended to be reusable. Alternately, the printing plates 18 may be automatically loaded into the cassette 102 using any suitable loading mechanism. The printing plates 18 are stacked with their emulsion sides facing toward the plate picking system The printing plate supporting and feeding system 104 is located within the cassette 102, and generally comprises a plurality of plate feed beams 110 that are attached to, and extend between, a pair of endless, rotatable timing belts 112 (only one is shown in FIG. 3). The stack 20 of printing plates 18 is located between the pair of timing belts 112. The plate feed beams 110 are configured to support large printing plates 18 without the need for a center support. The profile of each plate feed beam 110 is designed with a high stiffness to weight ratio such that, when supporting a printing plate 18 in the manner described below with regard to FIGS. 6 and 7, the plate feed beams 110 will not deflect and contact the underlying stack 20 of printing plates 18. In an alternate embodiment of the present invention, the stack 20 of printing plates 18, as well as the printing plate supporting and feeding system 104, are not enclosed within a cassette.

The timing belts 112 transfer the rotary motion of a drive system 114, such as an electric motor, to a linear motion of the plate feed beams 110. A guide roller (not shown) is positioned at the opposing side of each timing belt 112 to allow rotation of the timing belt. A controller (not shown) is used to accurately control the drive system 114 and resultant displacement of the timing belts 112 and plate feed beams 110 in a manner known in the art. As presented in greater detail below, the linear motion of the plate feed beams 110 operates to peel the top printing plate 18, off of the stack 20 of printing plates, allowing the top printing plate 18, to be subsequently loaded and mounted onto the media support surface 30 of the external drum 24.

The plate picker system 100 of the present invention is used to pick up a bottom edge of the top printing plate $\mathbf{18}_1$ from the stack 20. The plate picker system 100 generally comprises a plurality of suction cups 116 (only one is shown) arranged parallel to the bottom edge of the printing plates 18 on the stack 20, a system 118 for displacing the suction cups 116 relative to the top printing plate $\mathbf{18}_1$, and a vacuum source 56 for supplying a vacuum to the suction cups 116.

The general operation of the plate picking system 100 of the present invention, and the printing plate supporting and feeding system 104, is illustrated in FIGS. 4–8. The plate picking system 100 will be described in greater detail below with reference to FIGS. 10–16.

Figure 4:
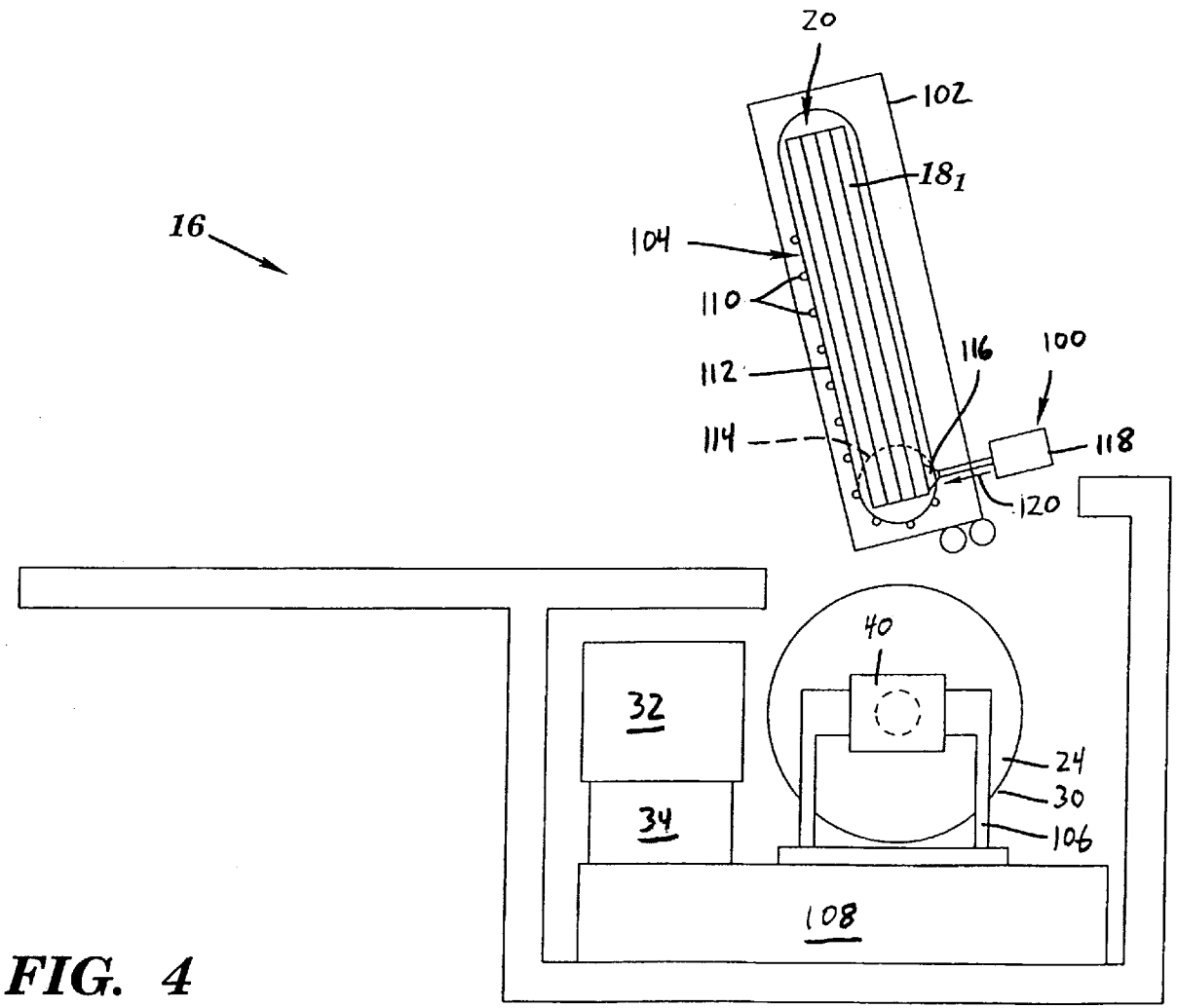
FIGS. 4–8 illustrate the operation of the external drum platesetter of FIG. 3.

In FIG. 4, with the plate feed beams 110 in a "home" position within the cassette 102, the suction cups 116 of the plate picking system 100 are moved by the displacing system 118 into contact with a bottom edge of the top printing plate $\mathbf{18}_1$ on the stack 20. The suction cups 116 are moved toward and against the bottom edge of the top printing plate $\mathbf{18}_1$ as indicated by directional arrow 120. A vacuum is applied to the suction cups 116 by the vacuum source, thereby securely coupling the bottom edge of the top printing plate $\mathbf{18}_1$ to the displacing system 118.

Figure 5:
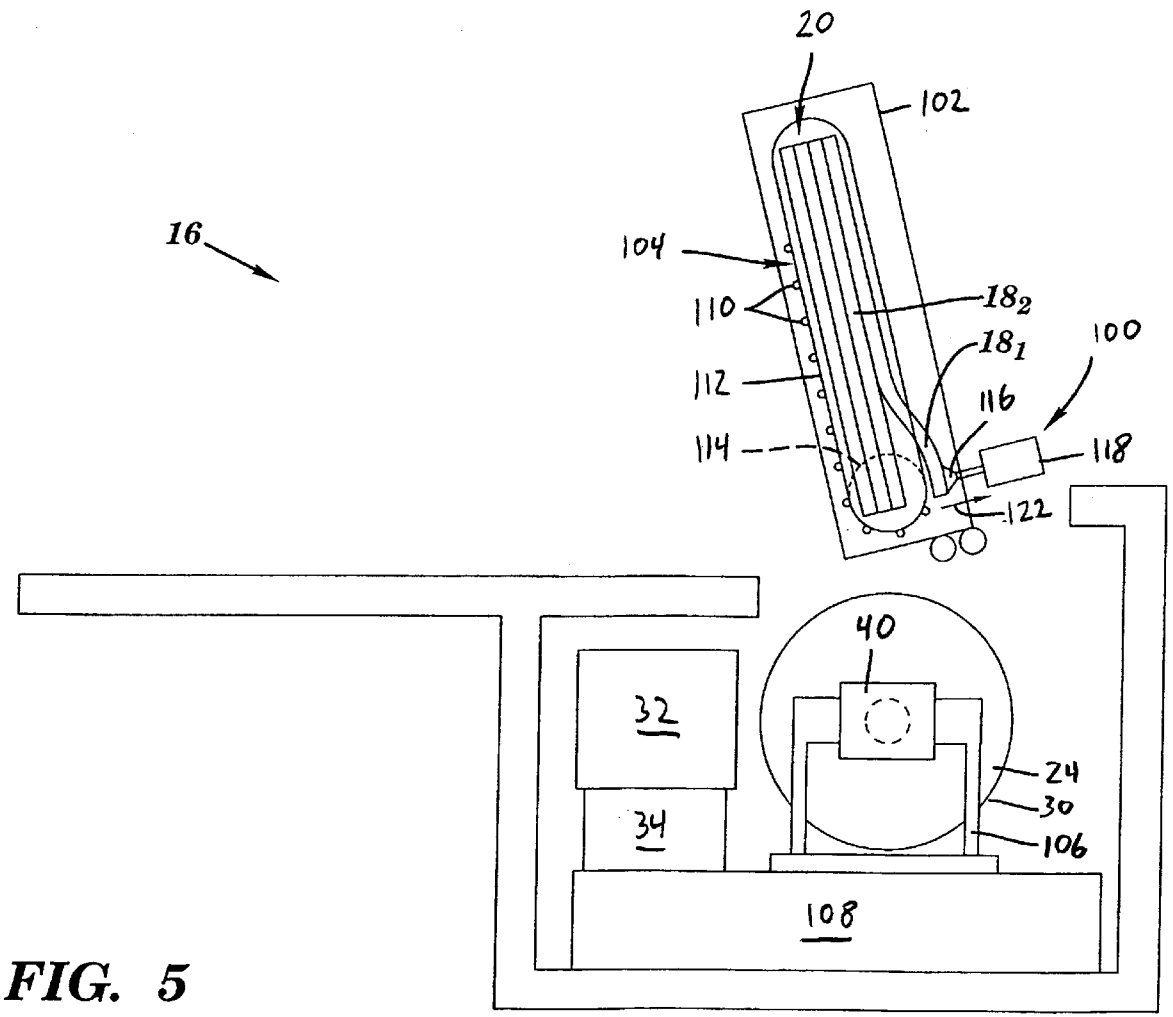

In FIG. 5, the bottom edge of the top printing plate $\mathbf{18}_1$ is peeled away from the stack 20 of printing plates as the displacing system 118 moves the suction cups 116 away from the stack 20 as indicated by directional arrow 122. The top printing plate $\mathbf{18}_1$ is displaced in direction 122 until the bottom edge of the top printing plate $\mathbf{18}_1$ is positioned outside the periphery of the timing belts 112. The bottom edge of the top printing plate $^{18}$, is held in this position by the displacing system 118.

Figure 6:
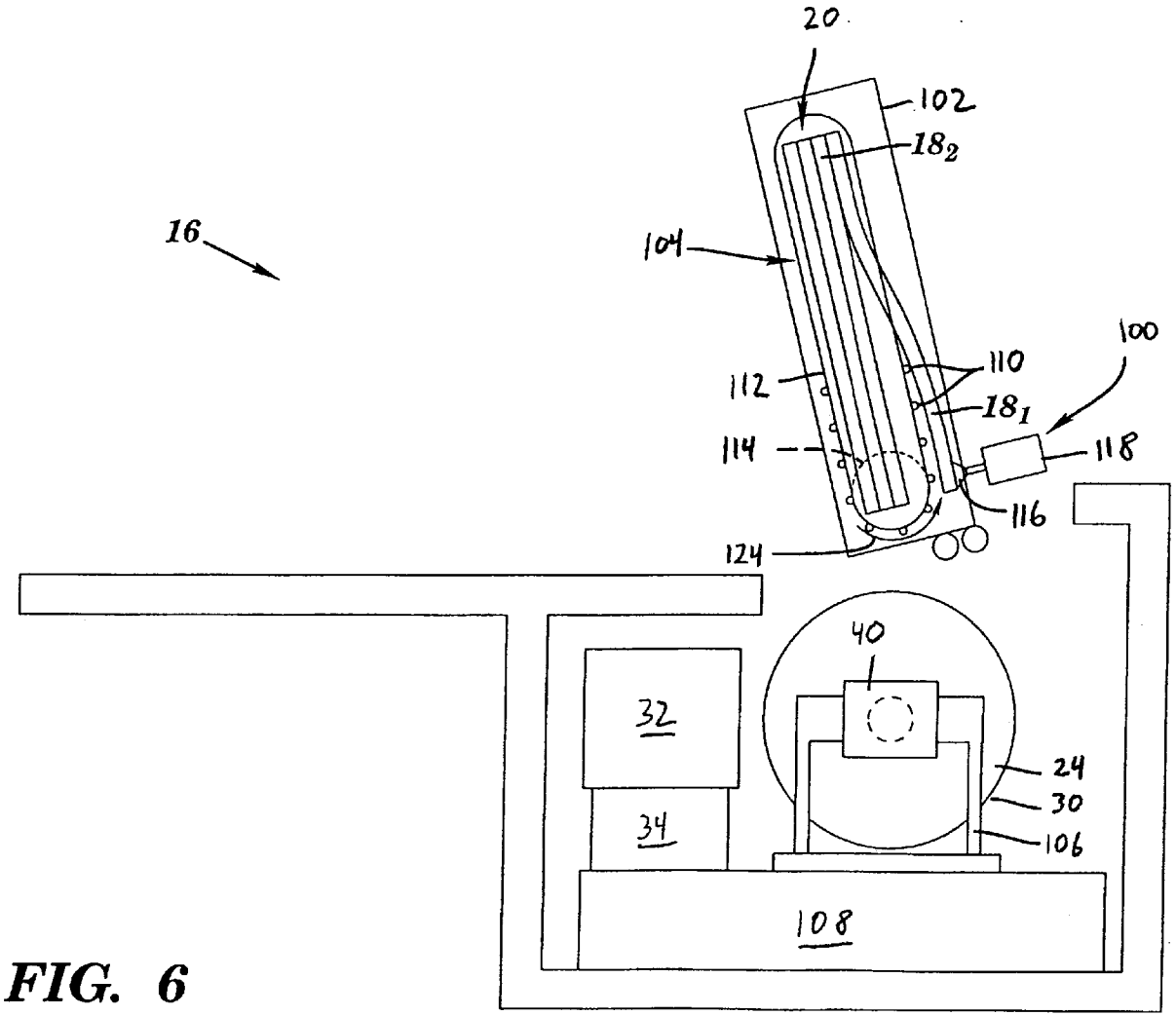
Figure 7:
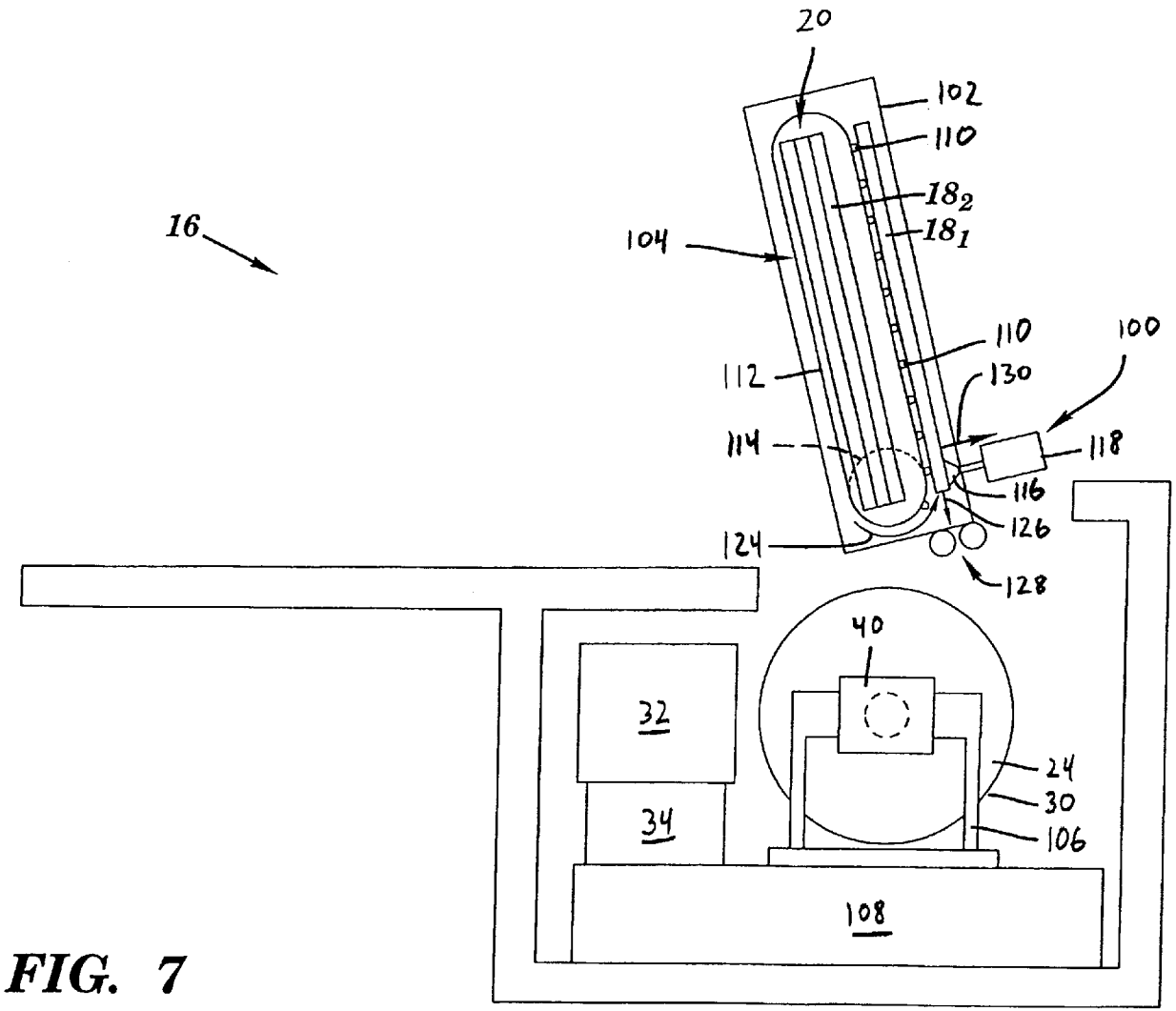

At this point in the operation of the printing plate supporting and feeding system 104, as illustrated in FIG. 6, the drive system 114 rotates the timing belts 112 in the direction indicated by directional arrow 124. This results in a corresponding displacement of the attached plate feed beams 110. As the leading plate feed beams 110 pass under the bottom edge of the top printing plate $\mathbf{18}_1$ that is coupled to, and held stationary by, the displacing system 118, the plate feed beams 110 engage and slide against the underside of the top printing plate 181, effectively peeling the top printing plate $\mathbf{18}_1$ away from, and partially off of, the next printing plate 182 on the stack 20. As shown in FIG. 7, rotation of the timing belts 112 continues in direction 124 until the top printing plate $\mathbf{18}_1$ is fully peeled off of the stack 20 and is supported by the plate feed beams 110. At this point, with the printing plate supporting and feeding system 104 in a "plate loaded" position within the cassette 102, the top printing plate $\mathbf{18}_1$ no longer contacts the next printing plate 182 on the stack 20. During the "peeling" operation, the plate feed beams 110 do not contact the top surface (i.e., the emulsion side) of the next printing plate $\mathbf{18}_2$ on the stack 20; the plate feed beams 110 only contact and slide against the underside of the top printing plate $\mathbf{18}_1$. This prevents the emulsion side of the next printing plate $\mathbf{18}_2$ from being damaged.

The displacing system 118 (and attached top printing plate $\mathbf{18}_1$) is shifted downward as indicated by directional arrow 126 to position the bottom edge of the top printing plate $\mathbf{18}_1$ above the nip rollers 128. The vacuum supplied by the vacuum source to the suction cups 116 is then released, and the suction cups 116 are displaced away from the top printing plate $\mathbf{18}_1$as indicated by directional arrow 130. Guide means may be provided within the cassette 102 to direct the bottom edge of the top printing plate $\mathbf{18}_1$between the pair of nip rollers 128.

The nip rollers 128, which may be formed as part of the cassette 102 or other suitable portion of the external drum platesetter 16, operate to direct the bottom (i.e., leading) edge of the top printing plate $\mathbf{18}_1$to a plate mounting system (not shown) that is configured to mount the printing plate onto the external drum 24 of the external drum platesetter 16 for subsequent imaging. The top printing plate $\mathbf{18}_1$ is shown mounted to the external drum 24 in FIG. 8. Such a mounting system is disclosed in detail, for example, in U.S. Pat. No. 6,295,929, entitled "External Drum Imaging System," which is incorporated herein by reference.

Figure 8:
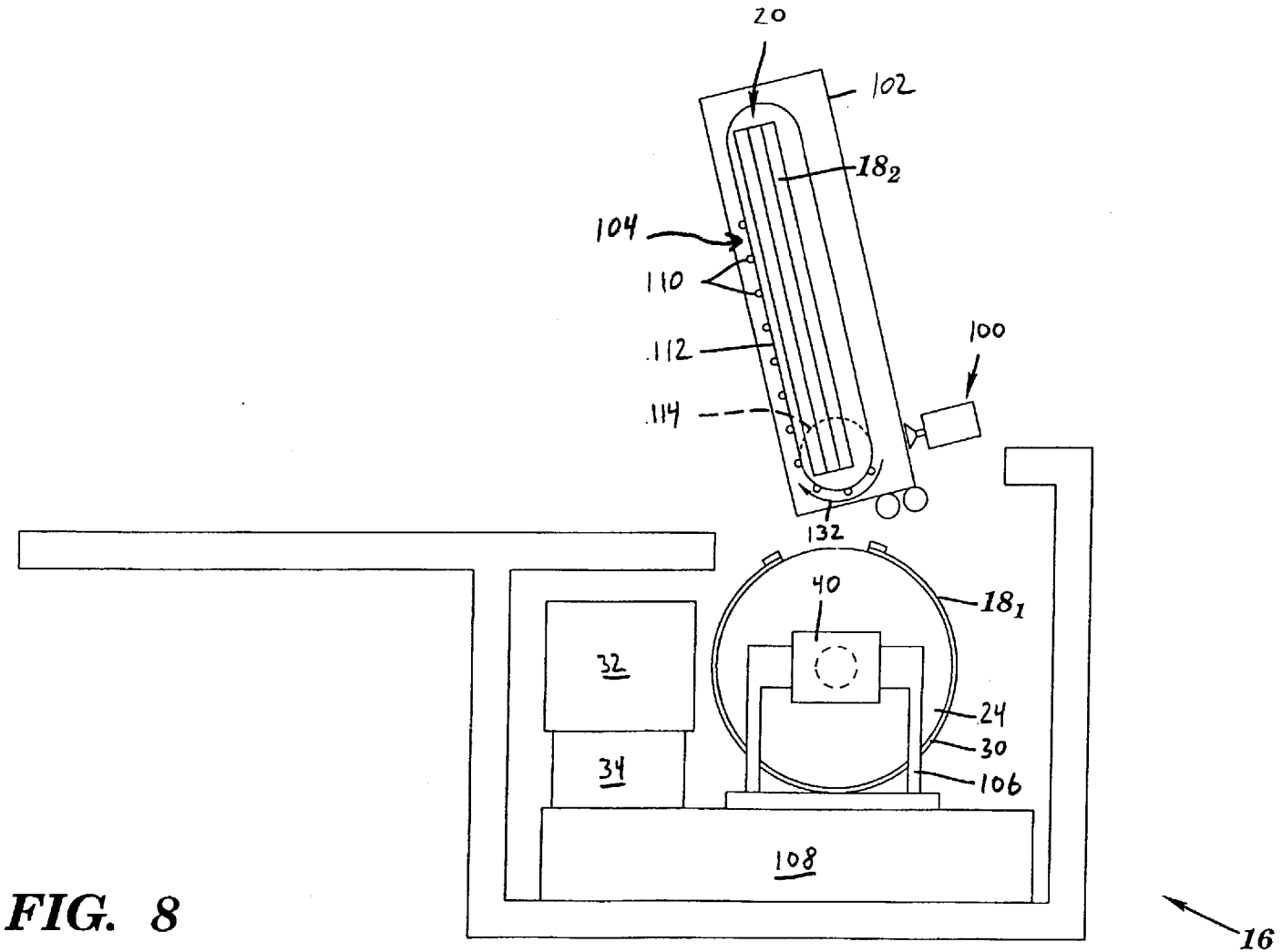

As illustrated in FIG. 8, after the printing plate $\mathbf{18}_1$ exits the cassette 102, the drive system 110 reverses the direction of rotation of the timing belts 112, thereby rotating the timing belts 112 in the direction indicated by directional arrow 132. The rotation of the timing belts 112, and the corresponding displacement of the plate feed beams 110, continues until the plate feed beams 110 are returned to their "home" position within the cassette 102. The next printing plate $\mathbf{18}_2$ on the stack 20, which now assumes the role of the "top" printing plate, can be fed from the cassette 102 to the external drum 24 by repeating the steps described above with regard to FIGS. 3–8.

Figure 9:
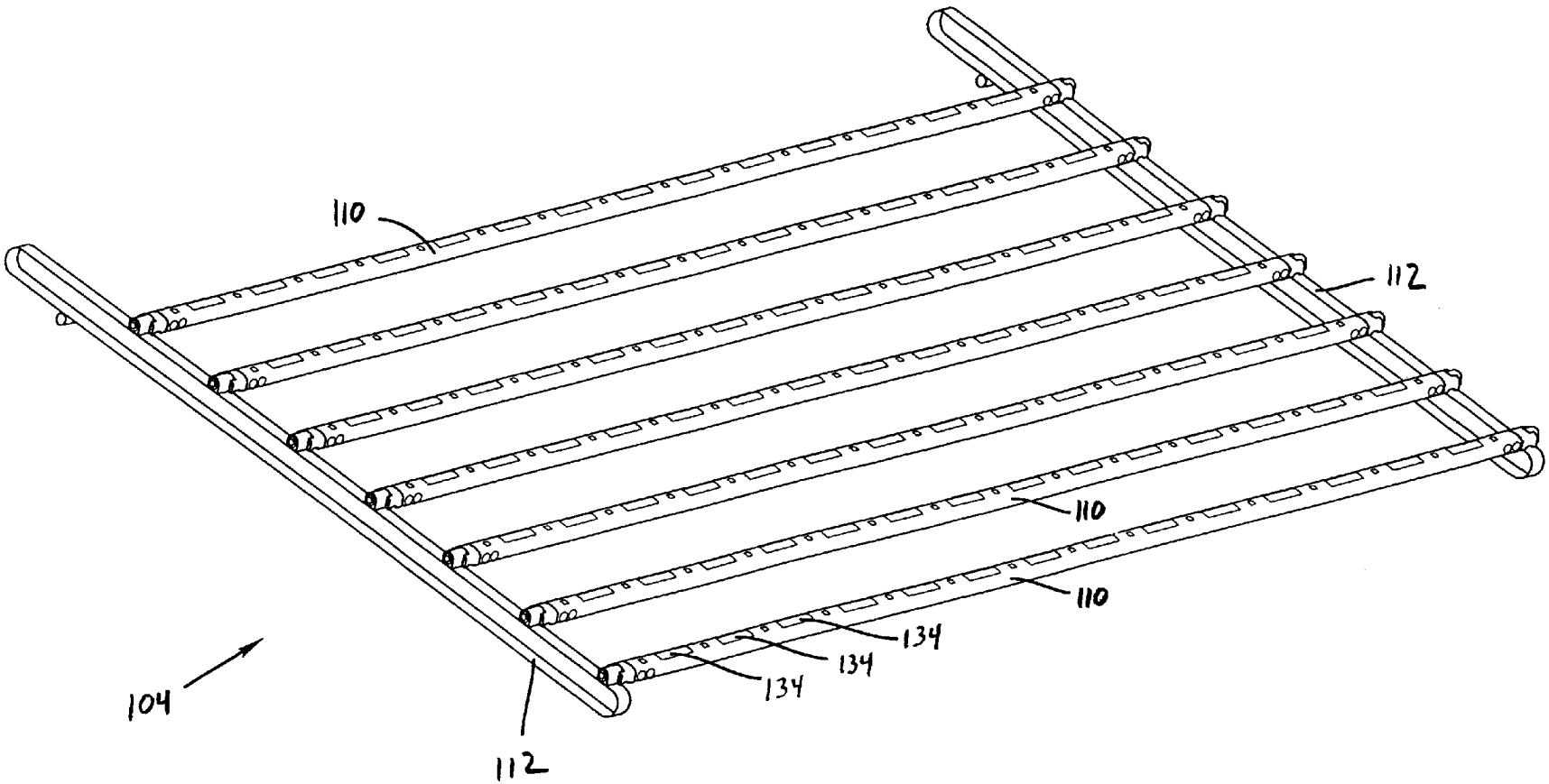
FIG. 9 illustrates the printing plate supporting and A feeding system.

The printing plate supporting and feeding system 104 of the present invention is illustrated in greater detail in FIG. 9. As shown, the printing plate supporting and feeding system 104 comprises a pair of timing belts 112 and a plurality of plate feed beams 110 attached to, and extending between, the timing belts 112. Each plate feed beam 110 includes a series of rotatable rollers 134 that allow a printing plate 18 and the plate feed beam 110 to slide across each other with minimal resistance.

The structure and operation of the plate picking system 100 of the present invention is illustrated in detail in FIGS. 10–16.

Figure 10:
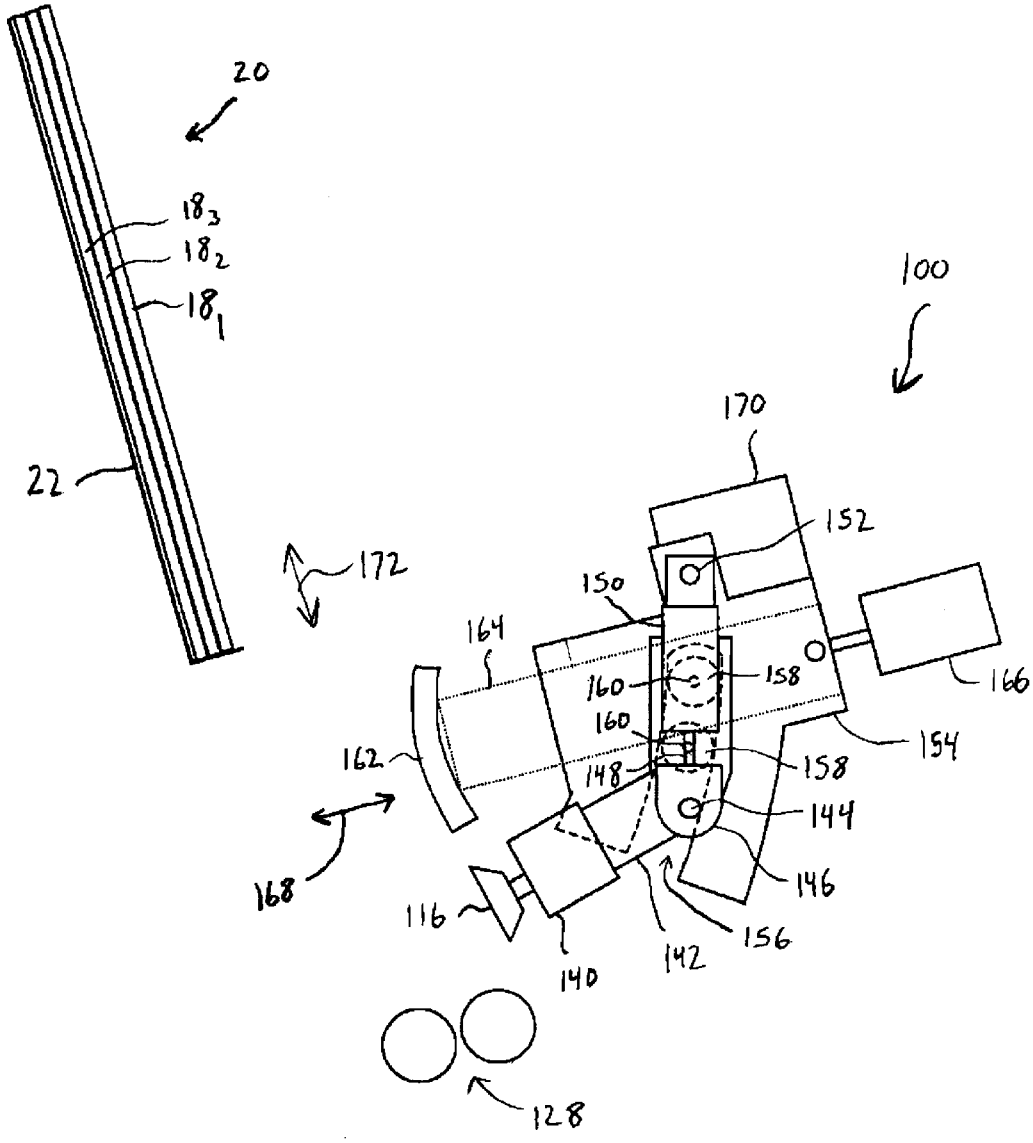
FIGS. 10–16 illustrate the structure and operation of the printing plate picking system of the present invention.

The plate picking system 100 of the present invention is illustrated in its home position adjacent the nip rollers 128 in FIG. 10. The plate picking system 100 includes a plurality of vacuum cups 116 (only one is shown) that are coupled to a vacuum manifold 140. A vacuum source 56 (FIG. 1) selectively supplies a vacuum to the plurality of suction cups 116 through the vacuum manifold 140. The vacuum cups 116 extend across at least a portion of the width of the stack 20 of printing plates 18 stored in the cassette 22. Only three printing plates $\mathbf{18}_1$, $\mathbf{18}_2$, $\mathbf{18}_3$, are illustrated in FIG. 10 for clarity The vacuum manifold is mounted to the end of a movable, angled bar 142. The angled bar 142 is secured to a pin 144 that is rotatably coupled to a drive system. In this embodiment, the drive system comprises a pneumatic cylinder 150, wherein the pin 144 is rotatably coupled to the end 146 of the piston 148 of the pneumatic cylinder 150. The pneumatic cylinder 150 is rotatably coupled to a pin 152 that is secured to a movable platform 154.

A curved slot 156 that comprises a segment of a circle is formed in the movable platform 154. A pair of wheels 158, which are attached to the underside of the angled bar 142 by axles 160, are positioned within the curved slot 156. The angled bar 142 is located above the movable platform 154. The pair of wheels 158 extend below the angled bar 142 into the curved slot 156.

An arc-shaped peeler 162 is positioned adjacent the vacuum cups 116. The arc-shaped peeler 162 extends across at least a portion of the width of the stack 20 of printing plates 18 stored in the cassette 22. A support 164 is mounted to each end of the arc-shaped peeler 162. A first drive system 166 is provided for displacing the peeler 162 and the movable platform 154 in unison toward and away from the stack 20 as indicated by directional arrow 168. The first drive system 166 may comprise any suitable type of linear drive system including a pneumatic cylinder, a motor driven belt/chain system, etc.

A second drive system 170 is provided for displacing the peeler 162, the movable platform 154, and the first drive system 166 in unison between the nip rollers 128 and the stack 20 of printing plates 18 in the cassette 22 as indicated by directional arrow 172. The second drive system 170 may also comprise any suitable type of linear drive system including a pneumatic cylinder, a motor driven belt/chain system, etc.

Figure 11:
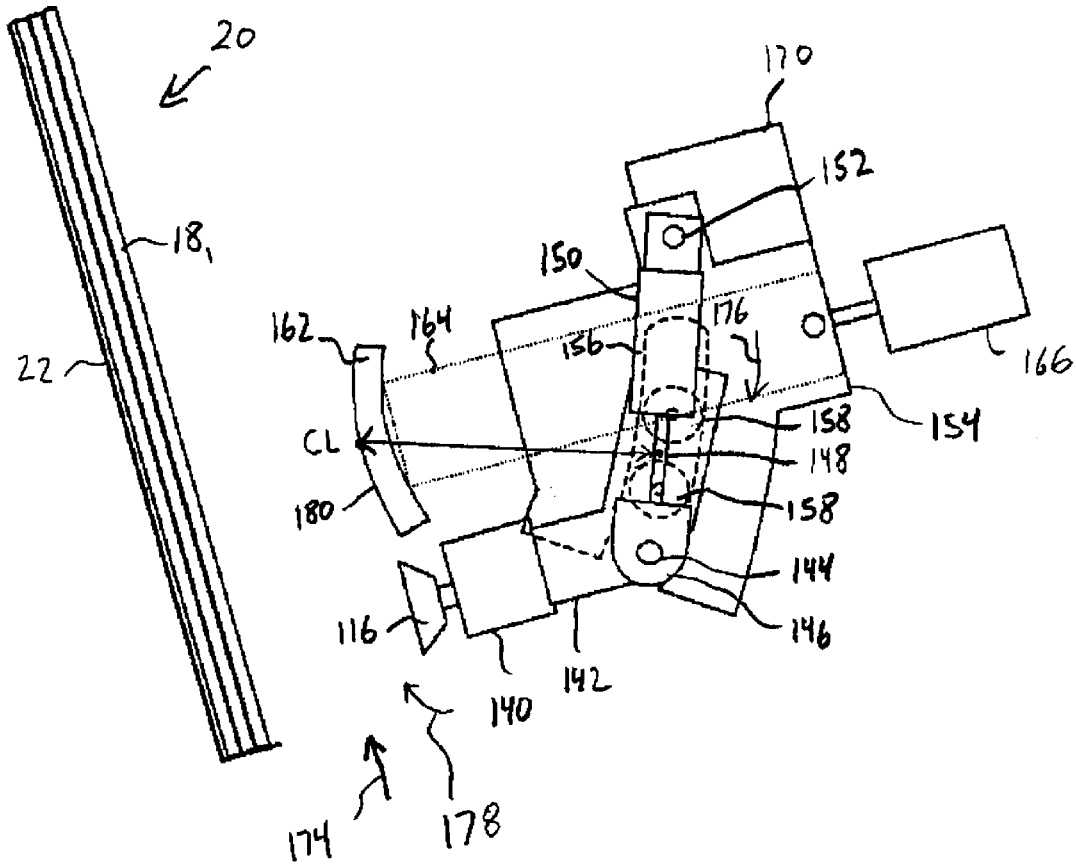
Figure 11:
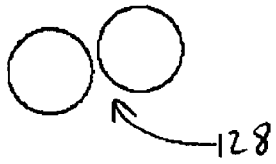
Figure 12:
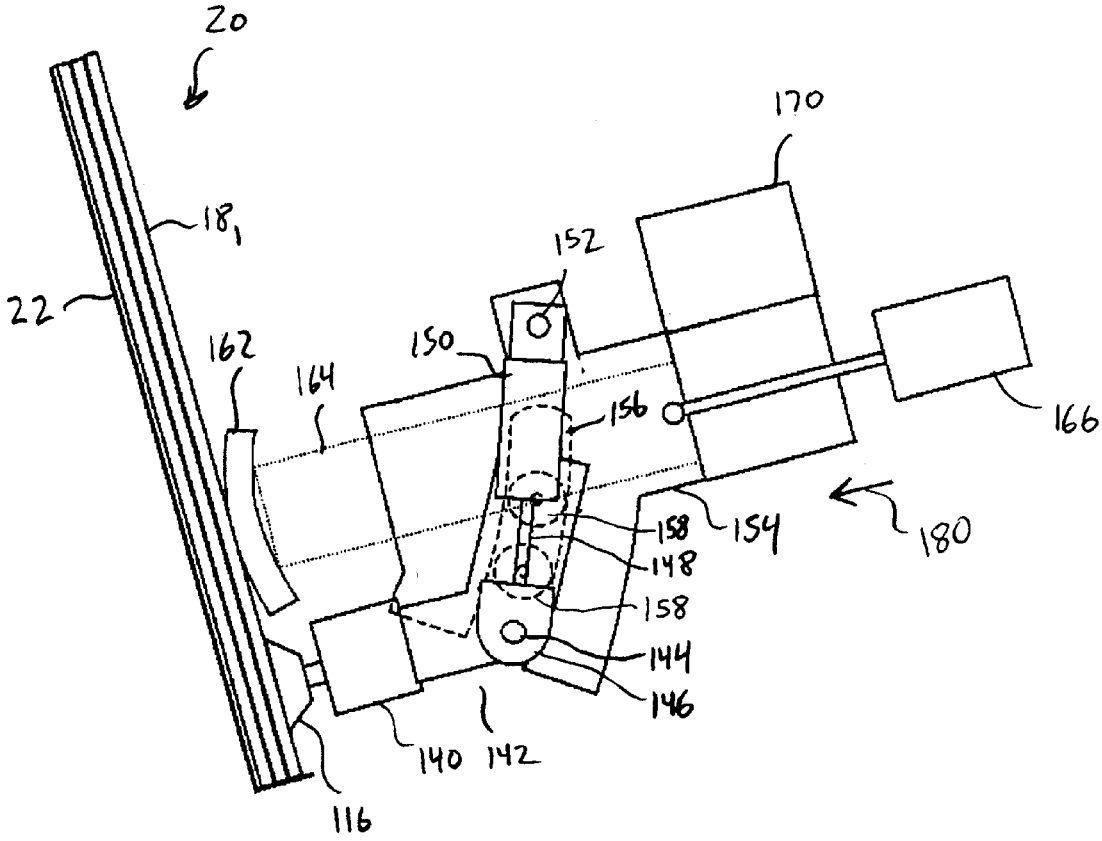
Figure 12:
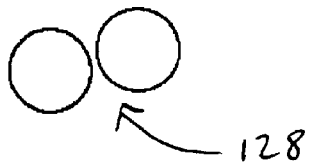

As shown in FIG. 11, the peeler 162, the movable platform 154, and the first drive system 166 are displaced by the second drive system 170 as indicated by directional arrow 174 to position the peeler 162 and the vacuum cups 116 adjacent the bottom edge of the top printing plate $\mathbf{18}_1$on the stack 20. The piston 148 of the pneumatic cylinder 150 is extended during or after the displacement. This results in a displacement of the wheels 158 of the angled bar 142 within the curved slot 156 as indicated by directional arrow 176. The curvature of the slot 156 causes the pin 144 and the angled bar 142 to rotate clockwise as indicated by directional arrow 178, thereby positioning the vacuum cups 116 even with the peeler 162 and normal to the surface of the top printing plate $\mathbf{18}_1$ on the stack 20. The centerline (CL) of rotation of the angled bar 142 within the curved slot 156 is located at the mid-point of the surface 180 of the peeler 162. Thereafter, as illustrated in FIG. 12, the first drive system 166 displaces the peeler 162 and the suction cups 116 as indicated by directional arrow 180 to position the peeler 162 and the suction cups 116 against the bottom edge of the top printing plate $\mathbf{18}_1$. A vacuum is subsequently supplied to the suction cups 116 through the vacuum manifold 140 to secure the suction cups 116 to the bottom edge of the top printing plate $\mathbf{18}_1$.

Figure 13:
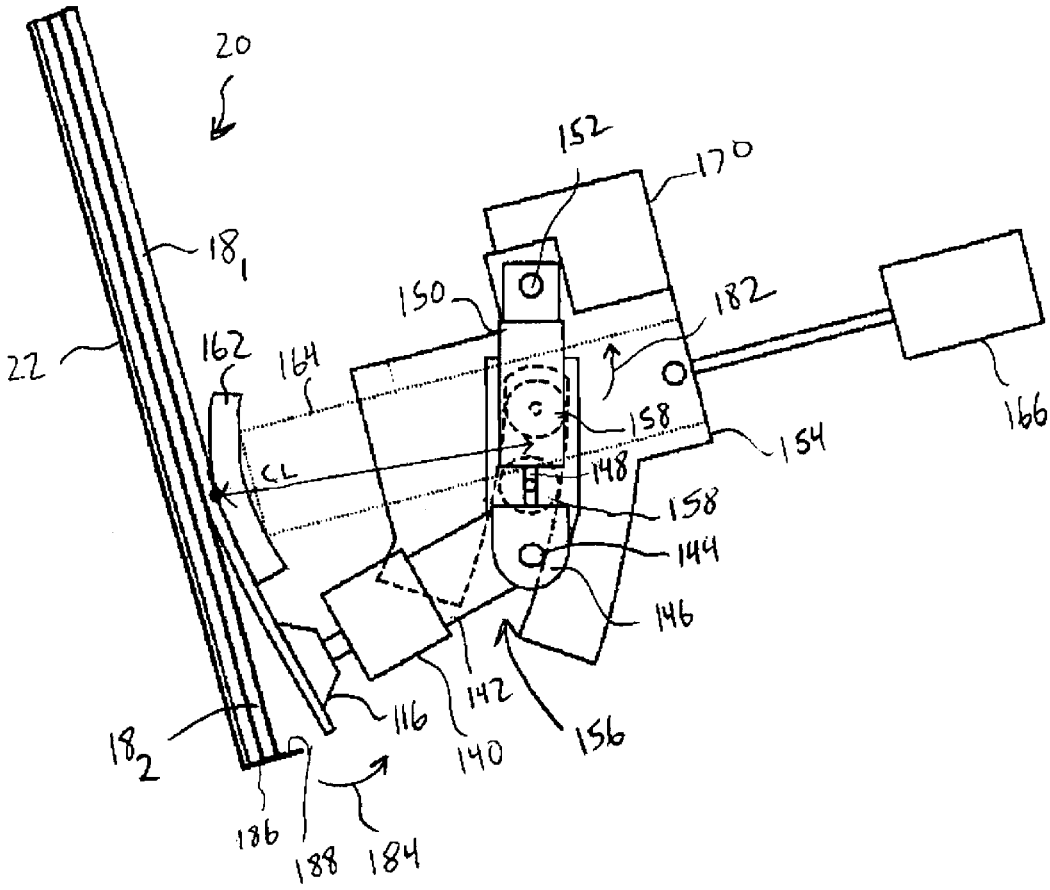
Figure 13:
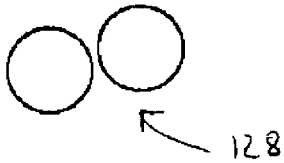

Once the top printing plate $\mathbf{18}_1$has been secured by the suction cups 116, the piston 148 of the pneumatic cylinder 150 is retracted as illustrated in FIG. 13. This results in a displacement of the wheels 158 of the angled bar 142 within the curved slot 156 as indicated by directional arrow $\mathbf{18}_2$. The curvature of the slot 156 causes the pin 144 and the angled bar 142 to rotate counter-clockwise as indicated by directional arrow 184, thereby peeling the bottom edge of the top printing plate $\mathbf{18}_1$ off of the stack 20. The centerline (CL) of rotation of the angled bar 142 within the curved slot 156 is located on the surface of the top printing plate $\mathbf{18}_1$ at the mid-point (i.e., the contact point) of the surface 180 of the peeler 162. This ensures that as the top printing plate $\mathbf{18}_1$ is peeled from the stack 20, there is no relative motion (e.g., rubbing) of the top printing plate $\mathbf{18}_1$ against the next, underlying printing plate $\mathbf{18}_2$ on the stack 20. The top printing plate $\mathbf{18}_1$, therefore, does not rub or otherwise damage the delicate emulsion surface of the next printing plate $\mathbf{18}_2$.

Figure 17:
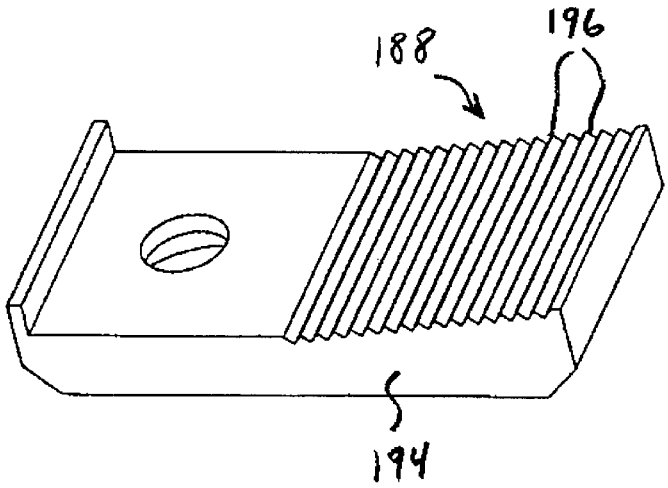
FIGS. 17–18 illustrate a lip segment of an exemplary plate rest.
Figure 18:
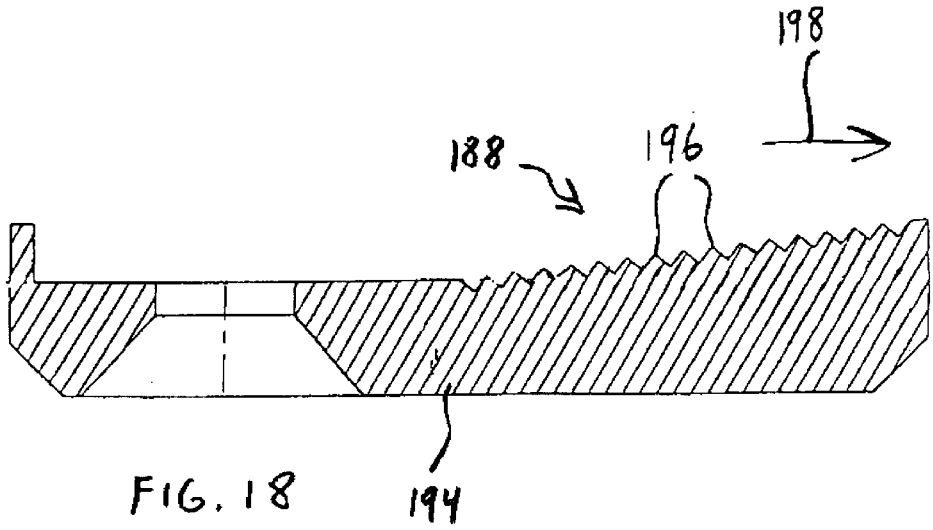

The cassette 22 includes a lip 186 that acts as a plate rest. The lip 186 has a friction surface 188 that, along with the peeling motion of the bottom edge of the top printing plate $\mathbf{18}_1$, ensures that only one printing plate 18 at a time is picked off of the stack 20. The lip 186 may be formed as a single unit, or using a plurality of lip segments that are spaced apart along the bottom edge of the cassette 22. An exemplary embodiment of such a lip segment 194 is illustrated in FIGS. 17 and 18. In particular, the lip segment 194 includes a friction surface 188 that is formed using a plurality of serrated teeth 196. The serrated teeth 196 are configured to rub against the bottom of a printing plate 18 as the printing plate 18 is peeled off of the stack 20 of printing plates 18 in the cassette 22 in direction 198. As shown in FIG. 18, the serrated teeth 196 may be situated on a plane that is oriented at an angle (e.g., 5–9 degrees) with respect to the bottom of the stack of printing plates. Other types of friction surfaces 188 may also be used in the practice of the present invention.

Figure 14:
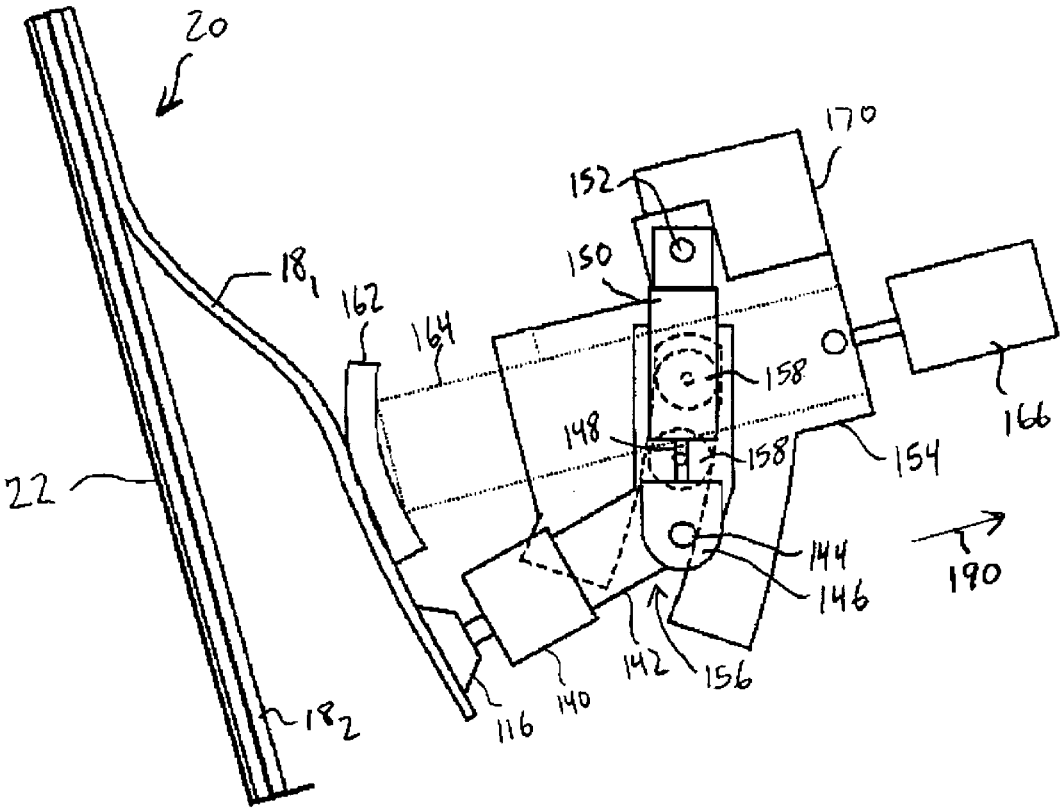
Figure 14:
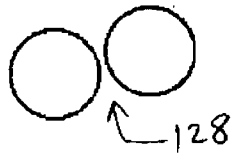
Figure 15:
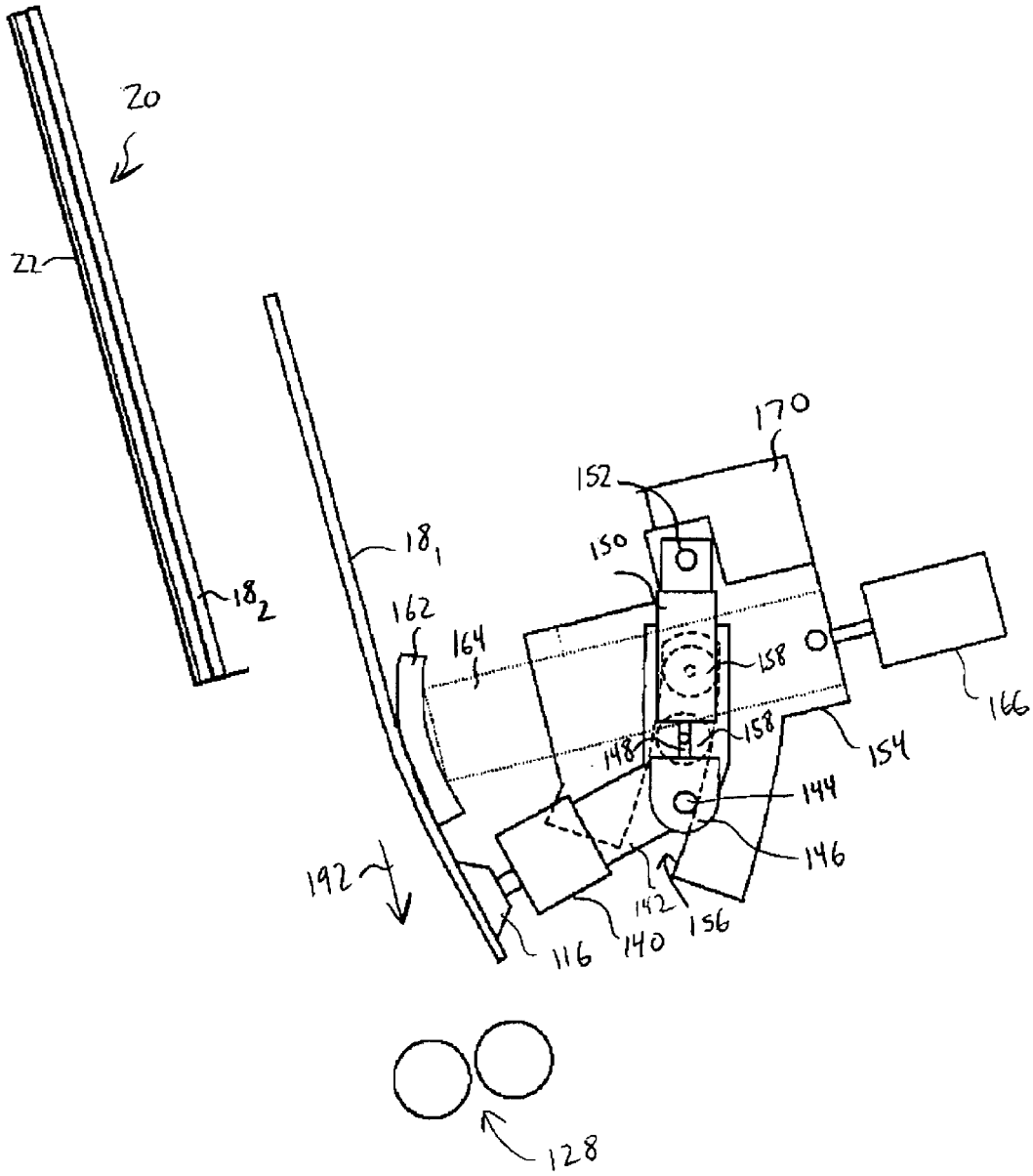
Figure 16:
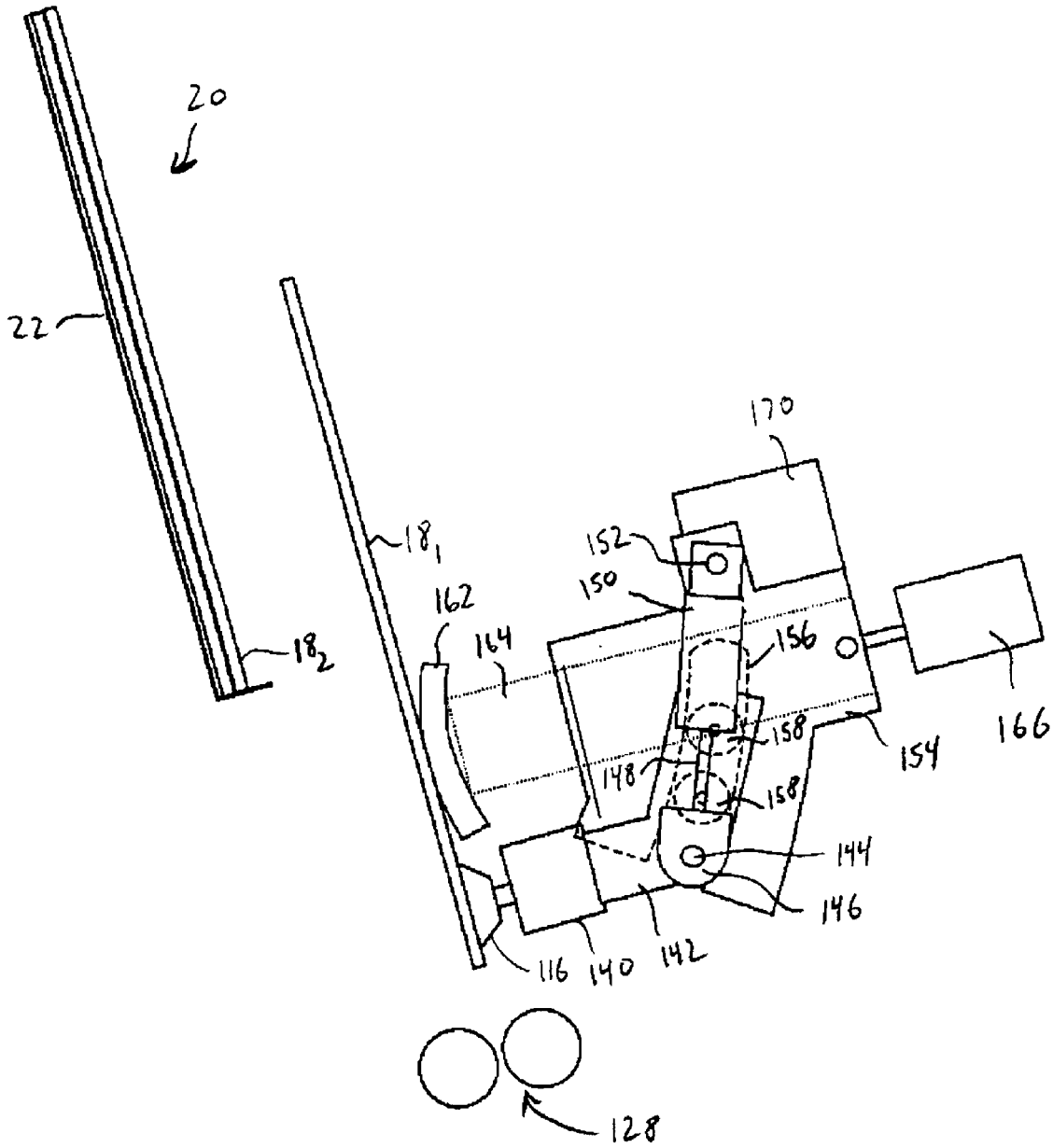

As illustrated in FIG. 14, the first drive system 166 displaces the peeler 162 and the suction cups 116 away from the stack 20 as indicated by directional arrow 190 to peel the top printing plate $\mathbf{18}_1$ further off of the stack 20. The top printing plate $\mathbf{18}_1$ is peeled off of the stack 20 a sufficient distance to provide clearance for the plate feed beams 110 of the printing plate supporting and feeding system 104 (FIG. 6). The top printing plate $\mathbf{18}_1$, which now rests on the plate feed beams of the printing plate supporting and feeding system (not shown), is displaced (FIG. 15) by the second drive system 170 toward the nip rollers 128 as indicated by directional arrow 192. Finally, as shown in FIG. 16, the piston 148 of the pneumatic cylinder 150 is extended to position the bottom edge of the top printing plate $\mathbf{18}_1$ above the center of the nip rollers 128. The input nips 128 direct the top printing plate $\mathbf{18}_1$ to a plate mounting system (not shown) that is configured to mount the top printing plate $\mathbf{18}_1$ onto the external drum 24 of the external drum platesetter 16 for subsequent imaging (FIG. 8). The above process can be repeated to pick and peel each remaining printing plate 18 off of the stack 20.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention.

What is claimed is:

1. An apparatus, comprising:

a plurality of suction cups;

an arc-shaped peeler; and a system for rotatably displacing the suction cups relative to the arc-shaped peeler;

wherein a center line of rotation of the displacing system is located at a mid-point of an outer surface of the arc-shaped peeler.

2. The apparatus of claim 1, wherein the displacing system comprises:

a platform;

an angled bar having a plurality of wheels, wherein the suction cups are coupled to the angled bar;

a curved slot formed in the platform, wherein the wheels of the angled bar are located within the curved slot; and a drive system for displacing the angled bar along the curved slot, wherein a displacement of the angled bar results in a rotation of the suction cups relative to the arc-shaped peeler.

3. The apparatus of claim 2, wherein the curved slot comprises a segment of a circle.

4. The apparatus of claim 2, wherein the drive system comprises a pneumatic cylinder.

5. The apparatus of claim 4, further comprising:

a pin for rotatably coupling an end of a piston of the pneumatic cylinder to the angled bar.

6. The apparatus of claim 4, further comprising:

a pin for rotatably coupling the pneumatic cylinder to the platform.

7. The apparatus of claim 1, further comprising:

a stack of printing plates, wherein the suction cups and the peeler contact a surface of a top printing plate on the stack, and wherein the center line of rotation of the displacing system is located at a contact point between the arc-shaped peeler and the surface of the top printing plate.

8. The apparatus of claim 7, further comprising:

a vacuum source for providing a vacuum to the suction cups to secure the suction cups to the surface of the top printing plate.

9. The apparatus of claim 7, wherein the displacing system displaces the suction cups away from the stack of printing plates, thereby peeling a portion of the top printing plate off of an underlying printing plate on the stack.

10. An apparatus for picking a printing plate from a stack of printing plates, comprising:

a plurality of suction cups;

an arc-shaped peeler;

a drive system for displacing the suction cups and the arc-shaped peeler against a surface of a top printing plate on the stack;

a vacuum source for supplying a vacuum to the suction cups to secure the suction cups against the surface of the top printing plate; and a system for rotatably displacing the suction cups relative to the arc-shaped peeler to peel a portion of the top printing plate off of the stack, wherein a center line of rotation of the displacing system is located at a contact point between the arc-shaped peeler and the surface of the top printing plate.

11. The apparatus of claim by 10, wherein the center line of rotation of the displacing system is located at a mid-point of an outer surface of the arc-shaped peeler.

12. The apparatus of claim 10, wherein the displacing system comprises:

a platform;

an angled bar having a plurality of wheels, wherein the suction cups are coupled to the angled bar;

a curved slot formed in the platform, wherein the wheels of the angled bar are located within the curved slot; and a second drive system for displacing the angled bar along the curved slot, wherein a displacement of the angled bar results in a rotation of the plurality of suction cups relative to the arc-shaped peeler.

13. The apparatus of claim 12, wherein the curved slot comprises a segment of a circle.

14. The apparatus of claim 12, wherein the second drive system comprises a pneumatic cylinder.

15. The apparatus of claim 14, further comprising:

a pin for rotatably coupling an end of a piston of the pneumatic cylinder to the angled bar.

16. The apparatus of claim 14, further comprising:

a pin for rotatably coupling the pneumatic cylinder to the platform.

17. The apparatus of claim 10, wherein the second drive system displaces the suction cups, the peeler, and the top printing plate that is secured to the suction cups away from the stack.

18. The apparatus of claim 17, further comprising:

a displacing system for displacing the top printing plate that is secured to the suction cups toward a pair of nip rollers.

19. The apparatus of claim 10, further comprising:

a plate rest for supporting the stack of printing plates, wherein the plate rest includes a friction surface.

20. The apparatus of claim 19, wherein the friction surface comprises a plurality of serrated teeth.

21. The apparatus of claim 20, wherein the serrated teeth are situated on a plane that is oriented at an angle with respect to a bottom of the stack of printing plates.

22. A method for picking a printing plate from a stack of printing plates, comprising:

displacing a plurality of suction cups and a peeler against a surface of a top printing plate on the stack;

supplying a vacuum to the suction cups to secure the suction cups against the surface of the top printing plate; and rotatably displacing the suction cups relative to the peeler to peel a portion of the top printing plate off of the stack, wherein a center line of rotation of the displacement is located at a contact point between the peeler and the surface of the top printing plate.

23. A method for picking a printing plate from a stack of printing plates, comprising:

displacing a plurality of suction cups and a peeler against a surface of a top printing plate on the stack;

supplying a vacuum to the suction cups to secure the suction cups against the surface of the top printing plate; and peeling a portion of the top printing plate off of the stack, and preventing relative motion of the top printing plate against an underlying printing plate on the stack, by rotatably displacing the suction cups relative to the peeler, wherein a center line of rotation of the displacement is located at a contact point between the peeler and the surface of the top printing plate.

24. An apparatus, comprising:

a plurality of suction cups;

a peeler; and a system for rotatably displacing the suction cups relative to the peeler, the displacing system including a platform, an angled bar having a plurality of wheels, wherein the suction cups are coupled to the angled bar, a curved slot formed in the platform, wherein the wheels of the angled bar are located within the curved slot, and a drive system for displacing the angled bar along the curved slot, wherein a displacement of the angled bar results in a rotation of the suction cups relative to the peeler;

wherein a center line of rotation of the displacing system is located on a surface of the peeler.

25. The apparatus of claim 24, wherein the peeler is arc-shaped.

26. The apparatus of claim 25, wherein the center line of rotation of the displacing system is located at a mid-point of the surface of the arc-shaped peeler.

27. The apparatus of claim 24, wherein the curved slot comprises a segment of a circle.

28. The apparatus of claim 24, wherein the drive system comprises a pneumatic cylinder.

29. The apparatus of claim 28, further comprising:

a pin for rotatably coupling an end of a piston of the pneumatic cylinder to the angled bar.

30. The apparatus of claim 28, further comprising:

a pin for rotatably coupling the pneumatic cylinder to the platform.

31. An apparatus for picking a printing plate from a stack of printing plates, comprising:

a plurality of suction cups;

a peeler;

a drive system for displacing the suction cups and the peeler against a surface of a top printing plate on the stack;

a vacuum source for supplying a vacuum to the suction cups to secure the suction cups against the surface of the top printing plate; and a system for rotatably displacing the suction cups relative to the peeler to peel a portion of the top printing plate off of the stack, the displacing system including a platform, an angled bar having a plurality of wheels, wherein the suction cups are coupled to the angled bar, a curved slot formed in the platform, wherein the wheels of the angled bar are located within the curved slot, and a second drive system for displacing the angled bar along the curved slot, wherein a displacement of the angled bar results in a rotation of the plurality of suction cups relative to the peeler, wherein a center line of rotation of the displacing system is located at a contact point between the peeler and the surface of the top printing plate.

32. The apparatus of claim 31, wherein the peeler is arc-shaped.

33. The apparatus of claim 32, wherein the center line of rotation of the displacing system is located at a mid-point of the surface of the arc-shaped peeler.

34. The apparatus of claim 31, wherein the curved slot comprises a segment of a circle.

35. The apparatus of claim 31, wherein the second drive system comprises a pneumatic cylinder.

36. The apparatus of claim 35, further comprising:

a pin for rotatably coupling an end of a piston of the pneumatic cylinder to the angled bar.

37. The apparatus of claim 35, further comprising:

a pin for rotatably coupling the pneumatic cylinder to the platform.

* * * * *